US006437670B1

(12) United States Patent
Castonguay et al.

(10) Patent No.: US 6,437,670 B1
(45) Date of Patent: Aug. 20, 2002

(54) MAGNETIC RELEASE SYSTEM FOR A CIRCUIT BREAKER

(75) Inventors: Roger N. Castonguay, Terryville; David Arnold, Chester, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,767

(22) Filed: Feb. 12, 2002

(51) Int. Cl.[7] ..... H01H 75/00

(52) U.S. Cl. ..... 335/6; 335/16; 335/21; 335/167; 335/168

(58) Field of Search ..... 335/6, 15, 16, 335/21, 22, 147, 167–176, 195, 204; 228/22, 154; 200/401

(56) References Cited

U.S. PATENT DOCUMENTS 4,764,650 A 8/1988 Bur et al. ..... 200/153
5,323,130 A * 6/1994 Arnold ..... 335/16
5,731,560 A 3/1998 Nebon et al. ..... 218/22
6,018,284 A 1/2000 Rival et al. ..... 335/16

* cited by examiner

*Primary Examiner*—Ramon M. Barrera
(74) *Attorney, Agent, or Firm*—Cantor Colburn LLP

(57) ABSTRACT

A magnetic release system for a circuit breaker, the magnetic release system includes a contact structure; a strap configured to conduct a first level of electrical current and a second level of electrical current; a u-shaped collar having a pole face, the u-shaped collar disposed around the strap; a release lever disposed proximate the pole face, the release lever rotatably mounted on the strap; wherein the release lever is releasably engaged with the contact structure; and wherein the release lever prevents movement of the contact structure at the first level of electrical current and releases the contact structure at the second level of electrical current.

20 Claims, 3 Drawing Sheets

MAGNETIC RELEASE SYSTEM FOR A CIRCUIT BREAKER

BACKGROUND OF INVENTION

Circuit breakers are used to protect equipment from overcurrent situations caused, for example, by short circuits or ground faults in or near such equipment. In the event an overcurrent condition occurs, electrical contacts within the circuit breaker will open, stopping the flow of electrical current through the circuit breaker to the equipment. Circuit breakers may be designed for high quiescent currents and high withstand currents. To maintain a high withstand current rating, the contacts must be clamped closed at the current withstand rating. On the other hand, the short circuit let-through current must be capable of opening the contacts quickly at short circuit. The drawback of having the contacts clamped closed is that the contacts may not be able to open quickly at the short circuit current level.

SUMMARY OF INVENTION

The above discussed and other drawbacks and deficiencies of the prior art are overcome or alleviated by a magnetic release system for a circuit breaker. In an exemplary embodiment of the invention, a magnetic release system for a circuit breaker includes a contact structure; a strap configured to conduct a first level of electrical current and a second level of electrical current; a u-shaped collar having a pole face, the u-shaped collar disposed around the strap; a release lever disposed proximate the pole face, the release lever rotatably mounted on the strap; wherein the release lever is releasably engaged with the contact structure; and wherein the release lever prevents movement of the contact structure at the first level of electrical current and releases the contact structure at the second level of electrical current.

In an alternative embodiment, a circuit breaker includes: a first contact structure in contact with a second contact structure; and a magnetic release system arranged to separate the first contact structure and the second contact structure, the magnetic release system including: a strap configured to conduct a first level of electrical current and a second level of electrical current, a u-shaped collar having a pole face, the u-shaped collar disposed around the strap, a release lever disposed proximate the first pole face, the release lever rotatably mounted on the strap, wherein the release lever is releasably engaged with the second contact structure, and wherein the release lever prevents movement of the second contact structure at the first level of electrical current and releases the second contact structure at the second level of electrical current.

BRIEF DESCRIPTION OF DRAWINGS

Referring to the exemplary drawings wherein like elements are numbered alike in the several Figures.

DETAILED DESCRIPTION

Figure 1:
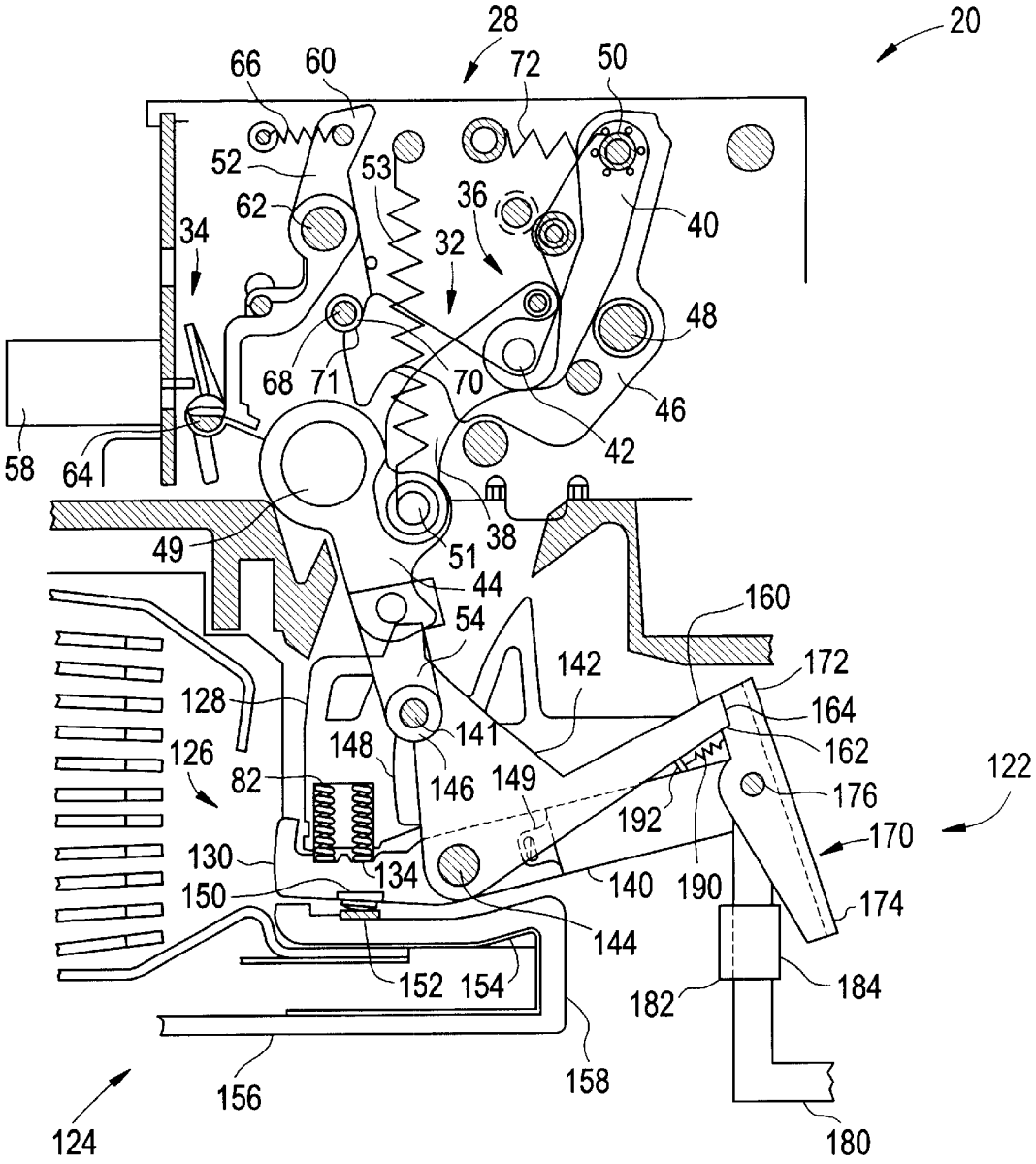
FIG. 1 is a schematic view of a pole of a circuit breaker comprising a magnetic release system.

Referring to FIG. 1, a multi-pole circuit breaker 20 comprises a magnetic release system 122 that provides a means for sensing a predetermined high withstand current in circuit breaker 20 and maintaining contact between a first contact structure 124 and a second contact structure 126 during the predetermined high withstand current. Magnetic release system 122 also provides a means for sensing a predetermined short circuit current and quickly releasing first and second contact structures 124 and 126, allowing them to separate in response to the short circuit current. Magnetic release system 122 operates independently of an operating mechanism 28 to latch and unlatch first contact structure 124 and second contact structure 126.

Operating mechanism 28 is supported by a frame 30 and comprises an operating linkage system 32 and a trip latch system 34. Operating linkage system 32 includes a toggle device 36 having a lower rod 38 and an upper rod 40 articulated on a pivoting axis 42. Operating linkage system 32 also includes a tripping hook 46, which is mounted with limited rocking movement on a main axis 48 between a loaded position, as shown in FIG. 1, and a tripped position, as will be described in further detail hereinafter. Main axis 48 is secured to frame 30. Lower rod 38 of operating linkage system 32 is pivotally coupled to second contact structure 126 through a crank 44 and a connecting rod 54. Crank 44 is pivotally secured to frame 30 by a pin 49 and is pivotally secured to lower rod 38 by a pin 51. A main operating spring 53 extends from frame 30 to pin 51 and biases crank 44 in the counter-clockwise direction around pin 49.

Trip latch system 34 includes an opening latch 52 releasably restrained by a trip latch 64. Opening latch 52 includes a locking lever 60 pivotally mounted on a spindle 62 between a locked position and an unlocked position. Trip latch system 34 also includes a return spring 66, which biases opening latch 52 counter-clockwise around spindle 62 to the locked position. A roller 68 is arranged on locking lever 60 between spindle 62 and trip latch 64 and operates to releasably engage a bearing surface 70 of tripping hook 46. Bearing surface 70 of tripping hook 46 has a recess 71 in which roller 68 engages. A return spring 72 is secured to frame 30 to bias tripping hook 46 counter-clockwise around main axis 48 to the loaded position, in which roller 68 of opening latch 52 is engaged in recess 71 of bearing surface 70.

In the loaded position shown, operating spring 53 biases crank 44 in a counter-clockwise direction around pin 49. Operating spring 53 also biases tripping hook 46 via lower rod 38 and upper rod 40, in a clockwise direction around main axis 48, which forces bearing surface 70 against roller 68. The force of bearing surface 70 against roller 68 biases opening latch 52 in a clockwise direction around spindle 62 and forces opening latch 52 against trip latch 64. Trip latch 64 prevents rotation of opening latch 52 around spindle 62, which, in turn, prevents rotation of tripping hook 46 around main axis 48 and rotation of crank 44 around pin 49.

Trip latch 64 may be rotated by a tripping component 58 to release locking lever 60, resulting in tripping of operating mechanism 28, which moves second contact structure 126 away from first contact structure 124. Tripping component 58 may be actuated manually, notably by means of a pushbutton.

Second contact structure 126 includes an insulating carrier 128 coupled to a movable contact arm 130, which is coupled to a load contact 150. Contact pressure springs 132 are arranged between carrier 128 and an upper face 134 of movable contact arm 130. Carrier 128 is coupled to connecting rod 54. Second contract structure 126 also includes movable contact arm 130 pivotally connected to a conductor 140 at coupling 149 and to an arm latch 142 by an axis 144. Arm latch 142 is releasably engaged to pin 146 at a latch surface 141. Pin 146 is pivotally coupled to connecting rod 54 and extends through a slot 148 disposed in carrier 128. Carrier 128 is also pivotally coupled to connection strap 180 by axis 176.

First contact structure 124 includes a line contact 152 coupled to a stationary contact arm 154. Stationary contact arm 154 is coupled to a contact strap 156 by a bridge conductor 158. First contact structure 124 is stationary and does not move. Second contact structure 126 contacts first contact structure 124 at load contact 150 and line contact 152.

Magnetic release system 122 includes arm latch 142, which has a latch end 160 that rests on a latch surface 162 of a release lever 170. Release lever 170 includes a first release arm 172 coupled to a second release arm 174 at an axis 176. Latch surface 162 is formed by a recess 164 in first release arm 172. Conductor 140 is pivotally connected to release lever 170 and a connection strap 180 at axis 176. A u-shaped collar 182, which has a pole face 184, is coupled to connection strap 180. U-shaped collar 182 may be a yoke, a c-shaped collar, or the like. A spring 190 is coupled to first release arm 172, which is biased so that spring 190 prevents release lever 170 from turning in a clockwise direction about axis 176. A calibration screw 192 is coupled with spring 190 and is threadably engaged to bias release lever 170 in a counter-clockwise direction. Calibration screw 192 provides a predetermined amount of tension on spring 190.

Magnetic release system 122 operates to latch and unlatch first and second contact structures 124 and 126 when operating mechanism 28 is latched and closed. When first contact structure 124 is in contact with second contact structure 126 (i.e., in the "closed", "locked", or "clamped" position), current flows from contact strap 156 through bridge conductor 158 to stationary contact arm 154 to line contact 152 to load contact 150. Current then flows through movable contact arm 130 to conductor 140 and to connection strap 180.

Because the current from stationary contact arm 154 to movable contact arm 130 is a reverse loop, there is a repulsive force between line contact 152 and load contact 150 that biases movable contact arm 130 in a direction away from stationary contact arm 154. However, when operating mechanism 28 is latched and closed and the current is not in excess of the withstand current rating, line contact 152 and load contact 150 are maintained in the closed position by arm latch 142, which holds second contact structure 126 so that second contact structure 126 does not pivot open about axis 176 under the influence of the repulsion force. The amount of current that can flow through circuit breaker 20 without tripping circuit breaker 20 is called the withstand level. Because first contact structure 124 and second contact structure 126 stay in the closed position, the circuit breaker is "withstanding" the flow of current.

Figure 2:
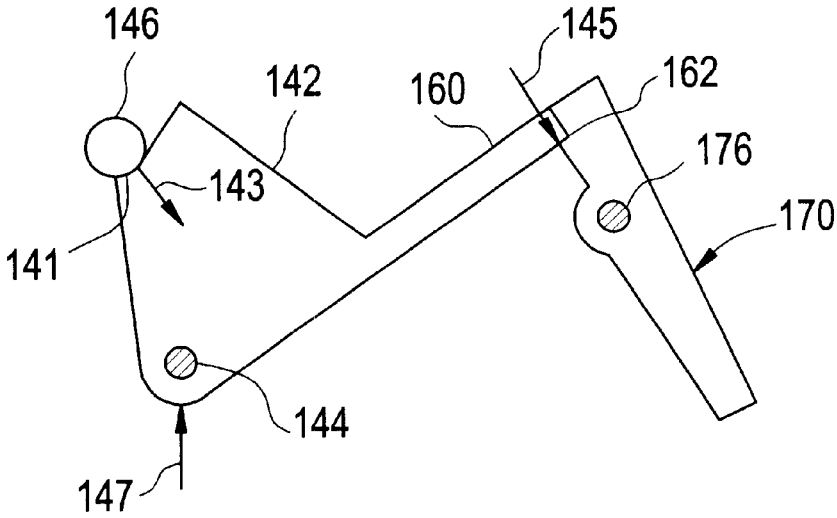
FIG. 2 is a schematic view of an arm latch in the closed position relative to a release lever.

Referring to FIG. 2, arm latch 142 is shown in greater detail. FIG. 2 illustrates arm latch 142 in the closed position. The repulsive force between first and second contact structures 124 and 126 (shown in FIG. 1) creates a force 147 on axis 144. Force 147 creates a reaction force 143 between pin 146 and latch surface 141 in which reaction force 143 is normal to latch surface 141. Reaction force 143 creates a moment about axis 144 in which the moment is in the clockwise direction. That moment creates a force 145 at latch end 160 in which force 145 presses on latch surface 162.

Referring again to FIG. 1, the current flows from conductor 140 to connection strap 180. As current flows through connection strap 180, a magnetic flux is induced in u-shaped collar 182, thereby creating a magnetic force between pole face 184 and second release arm 174. As current increases though connection strap 180, the magnetic attraction between pole face 184 and second release arm 174 increases and second release arm 174 attempts to move towards pole face 184, thereby creating a clockwise rotation in release lever 170 about axis 176. However, first release arm 172 is held in place by spring 190 and the frictional loading between latch surface 162 on first release arm 172 and latch end 160 on arm latch 142.

When the magnetic force is large enough to overcome spring 190 and the frictional loading between latch surface 162 and latch end 160, release lever 170 rotates towards pole face 184. Latch surface 162 moves away from latch end 160 on the arm latch 142. Once latch end 160 is released from latch surface 162, the opposing force between movable contact arm 130 and stationary contact arm 154, allow arm latch 142 to pivot about axis 144 in a clockwise direction. As arm latch 142 pivots about axis 144, second contact structure 126 and movable contact arm 130 pivot clockwise about axis 176. Slot 148 allows second contact structure 126 and arm latch 142 to move upwards relative to pin 146. Thus, pin 146 remains stationary.

Figure 3:
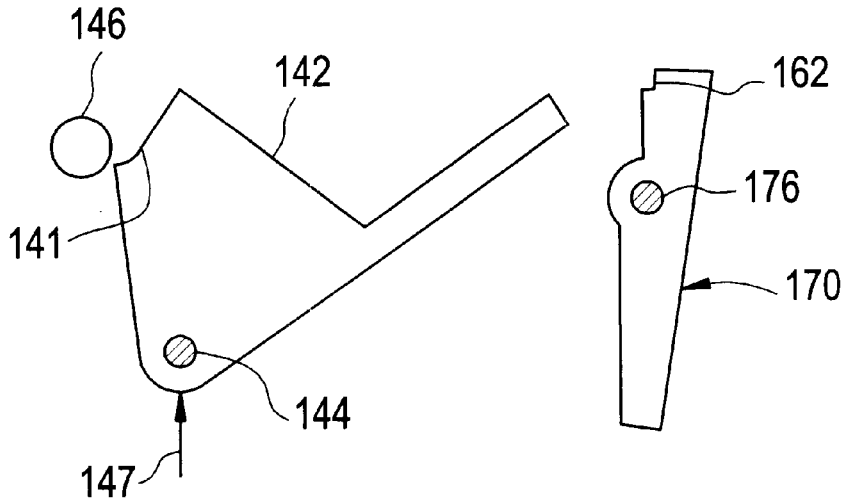
FIG. 3 is a schematic view of an arm latch in the open position relative to a release lever.

FIG. 3 illustrates arm latch 142 at the moment release lever 170 rotates clockwise about axis 176. The moment acting in the clockwise direction about axis 144 rotates arm latch 142 in the clockwise direction. As arm latch 142 rotates in the clockwise direction, reaction force 143 continues to act on latch surface 141 until pin 146 is no longer contacting latch surface 141. Once pin 146 is no longer contacting latch surface 141, arm latch 142 is then free to move in the upward direction, along with second contact structure 126, in a rotational manner about axis 176 and away from first contact structure 124.

Referring again to FIG. 1, when movable contact arm 130 moves upwards, movable contact arm 130 moves away from first contact structure 124 so that line contact 152 and load contact 150 are no longer touching. When line contact 152 and load contact 150 separate, the circuit breaker is "tripped" and current can no longer flow through the circuit breaker.

Circuit breaker 20 can also trip by means of operating mechanism 28. Operating mechanism 28 trips when trip latch 64 rotates in a clockwise direction, which allows opening latch 52 to pivot about spindle 62 in a clockwise direction under the force of tripping hook 46 until bearing surface 70 is released from roller 68. Once bearing surface 70 is released from roller 68, tripping hook 46 is free to rotate about main axis 48. In addition, crank 44 is free to rotate about pin 49 under the urgence of operating spring 53, which causes second contact structure 126 to move away from first contact structure 124 so that line contact 152 and load contact 150 are no longer touching. When line contact 152 and load contact 150 separate, the circuit breaker is "tripped" and current can no longer flow through the circuit breaker.

Under quiescent current conditions when operating mechanism 28 is operating in an open or close mode, second contact structure 126, arm latch 142, and release lever 170 move in unison about axis 176, whereby latch end 160 remains engaged with latch surface 162 on release lever 170, and pin 146 remains captured between latch surface 141 on arm latch 142 and the upper end of slot 148 on carrier 128, as shown in FIG. 1. Under short circuit current conditions when the magnetic release system 122 actuates, as described above, the clockwise rotation of arm latch 142 about axis 144 permits second contact structure 126 to be divorced from operating mechanism 28 and to move in a clockwise direction about axis 176, whereby pin 146 remains stationary but travels relatively and in a radial manner within slot 148. To prevent rebound and reclosure of second contact structure 126 after it has opened and before operating mechanism 28 trips, a retention spring (not shown) is provided to hold the carrier 128 in the open position.

Figure 4:
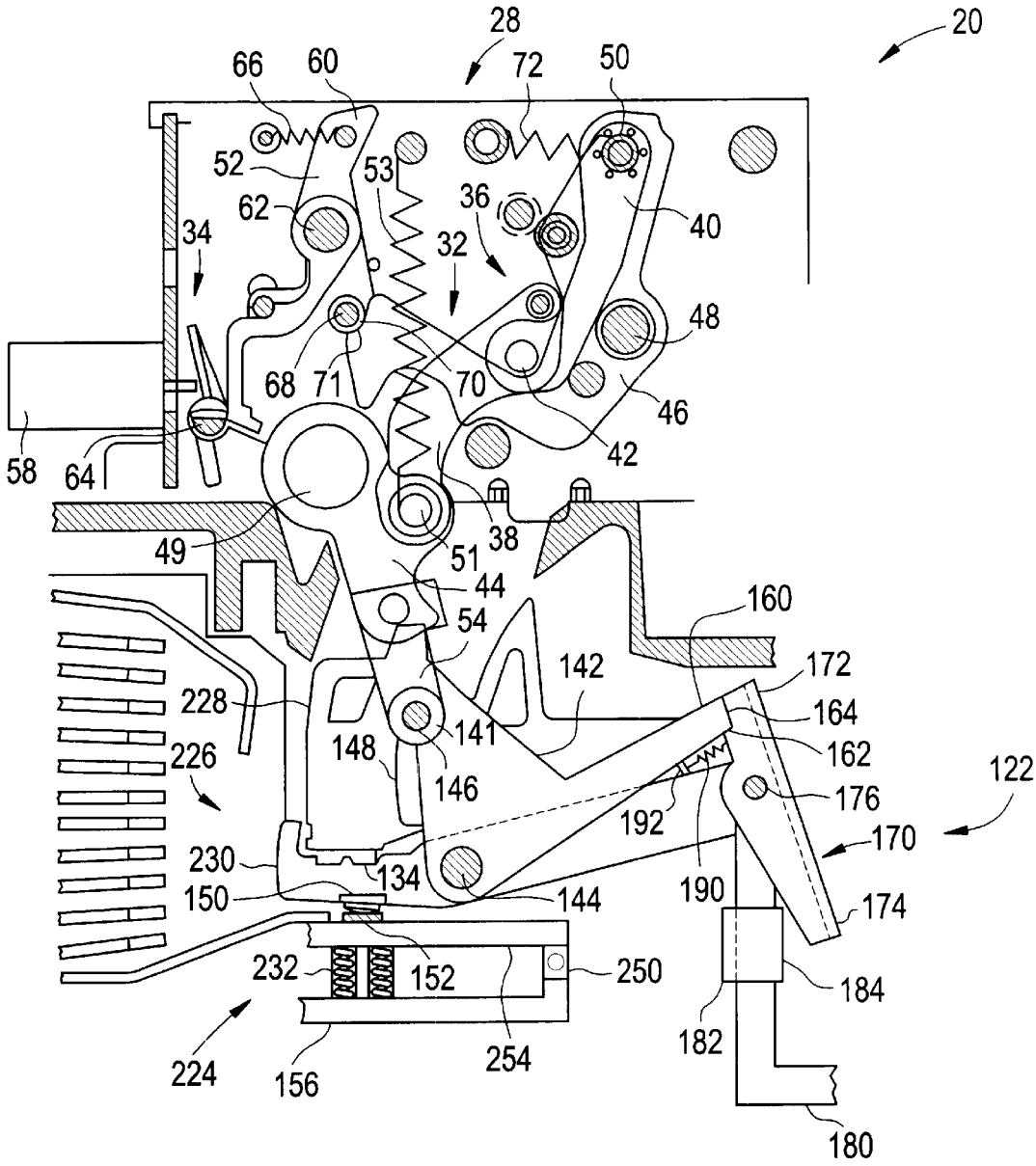
FIG. 4 is a schematic view of an alternative embodiment of a pole of a circuit breaker comprising a magnetic release system.

Referring to FIG. 4, magnetic release system 122 is shown with an alternative contact structure. In FIG. 4, the contact structure includes a first contact structure 224 and a second contact structure 226 wherein contact pressure springs 232 act on first contact structure 224.

Second contact structure 226 includes an insulating carrier 228 coupled to a movable contact arm 230. Load contact 150 is coupled to movable contact arm 230. Carrier 228 is coupled to connecting rod 54 by pin 146. Movable contact arm 230 is pivotally connected to connection strap 180 by axis 176. Carrier 228 is also pivotally connected to connection strap 180 by axis 176.

Second contact structure 226 contacts first contact structure 224 at load contact 150. First contact structure 224 includes line contact 152 coupled to a contact arm 254. Contact arm 254 is coupled to contact strap 156 by an axis 250. Contact pressure springs 232 are arranged between contact arm 254 and contact strap 156. Contact pressure springs 232 allow contact arm 254 to move when second contact structure 226 contacts first contact structure 224.

Circuit breaker 20 operates in the loaded position as shown and in the following manner. The current flows into contact strap 156 and flows through axis 250 to contact arm 254. Current crosses from line contact 152 to load contact 150 to movable contact arm 230. Current then flows through axis 176 to connection strap 180.

When movable contact arm 230 closes to the loaded position, contact arm 254 moves towards contact strap 156 by pivoting on axis 250 and compressing contact pressure springs 232. There is a reverse loop created from the current flowing from left to right in contact arm 254 and current flowing from right to left in movable contact arm 230. The reverse loop causes a force at line contact 152 and load 150 that creates a clockwise moment on movable contact arm 230 about axis 176. However, line contact 152 and load contact 150 stay in the closed position because arm latch 142 holds movable contact arm 230 so that movable contact arm 230 does not pivot open. The initial rush of current is called the withstand rating of the circuit breaker because first contact structure 224 and second contact structure 226 stay in the closed position and are withstanding the flow of current. Magnetic release system 122 and operating mechanism 28 operate and trip in the same manner as described in the embodiment described in FIG. 1.

One of the advantages of the disclosure is that the releasing action of magnetic release system 122 can occur very quickly. In each of the embodiments described, the release lever is preloaded during the withstand current level. Thus, when the short circuit current level has been reached and the magnetic release system trips the circuit breaker, the release lever moves in a quick snapping action. A second advantage of the disclosure is that the reverse loop between the first contact structure and the second contact structure also creates a force between the first contact structure and the second contact structure whereby a repulsion force is established between the second contact structure and the first contact structure. This force allows the second contact structure to be repelled from the first contact structure when the arm latch is released. A third advantage of the disclosure is the rapid movement of the second contact structure independent of the operating mechanism when the magnetic release system is actuated, thereby enabling rapid extinction of the short circuit current that is not dependent on the actuation of additional mechanism parts.

Magnetic release system 122 as described herein may be used to interrupt current in any type of system. Most notably, magnetic release system 122 may be employed in any residential, commercial, or industrial circuit breakers, including an air circuit breaker, a molded case circuit breaker, a multi-pole circuit breaker, and a rotary circuit breaker.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A magnetic release system for a circuit breaker, said magnetic release system comprising:

a contact structure;

a strap configured to conduct a first level of electrical current and a second level of electrical current;

a u-shaped collar having a pole face, said u-shaped collar disposed around said strap;

a release lever disposed proximate said pole face, said release lever rotatably mounted on said strap;

wherein said release lever is releasably engaged with said contact structure; and wherein said release lever prevents movement of said contact structure at said first level of electrical current and releases said contact structure at said second level of electrical current.

2. The magnetic release system of claim 1, further comprising a spring operatively coupled with said release lever.

3. The magnetic release system of claim 1, wherein said contact structure includes:

a movable contact arm; and an arm latch pivotally coupled to said movable contact arm.

4. The magnetic release system of claim 3, wherein said release lever is pivotally coupled to said movable contact arm.

5. The magnetic release system of claim 3, wherein said release lever includes:

a recess at an end of said release lever; and wherein an arm latch end rests on said recess.

6. The magnetic release system of claim 1, wherein said first level of electrical current is a withstand level.

7. The magnetic release system of claim 1, wherein said second level of electrical current is a short circuit level.

8. A circuit breaker comprising:

a first contact structure in contact with a second contact structure; and a magnetic release system arranged to separate said first contact structure and said second contact structure, said magnetic release system comprising:

a strap configured to conduct a first level of electrical current and a second level of electrical current, a u-shaped collar having a pole face, said u-shaped collar disposed around said strap, a release lever disposed proximate said pole face, said release lever rotatably mounted on said strap, wherein said release lever is releasably engaged with said second contact structure, and wherein said release lever prevents movement of said second contact structure at said first level of electrical current and releases said second contact structure at said second level of electrical current.

9. The circuit breaker of claim 8, further comprising a spring operatively coupled with said release lever.

10. The circuit breaker of claim 8, wherein said second contact structure includes:

a movable contact arm; and an arm latch pivotally coupled to said movable contact arm.

11. The circuit breaker of claim 10, wherein said release lever is pivotally coupled to said movable contact arm.

12. The circuit breaker of claim 10, wherein said release lever includes:

a recess at an end of said release lever; and wherein an arm latch end rests on said recess.

13. The circuit breaker of claim 8, wherein said first level of electrical current is a withstand level.

14. The circuit breaker of claim 8, wherein said second level of electrical current is a short circuit level.

15. The circuit breaker of claim 8, wherein said first contact structure includes:

a contact arm; and a contact strap operatively coupled to said contact arm.

16. The circuit breaker of claim 8, wherein said second contact structure includes:

an insulating carrier;

a movable contact arm operatively coupled to said insulating carrier; and a contact pressure spring arranged between said insulating carrier and an upper face of said movable contact arm.

17. The circuit breaker of claim 8, wherein said first contact structure includes:

a contact arm;

a contact strap pivotally coupled to said contact arm; and a contact pressure spring arranged between said contact arm and said contact strap.

18. The circuit breaker of claim 8, wherein said second contact structure includes:

an insulating carrier; and a movable contact arm operatively coupled to said insulating carrier.

19. The circuit breaker of claim 8, further comprising an operating mechanism, said operating mechanism in operable communication with said second contact structure; and wherein said operating mechanism arranged to separate said first contact structure and said second contact structure.

20. A circuit breaker comprising:

a first contact structure in contact with a second contact structure; and a magnetic release system arranged to separate said first contact structure and said second contact structure, said magnetic release system comprising:

a strap configured to conduct a first level of electrical current and a second level of electrical current, a u-shaped collar having a pole face, said u-shaped collar disposed around said strap, a release lever disposed proximate said pole face, said release lever rotatably mounted on said strap, means for releasably engaging said release lever with said second contact structure, and means for preventing movement of said release lever at said first level of electrical current and releasing said release lever at said second level of electrical current.

* * * * *